United States Patent [19]

Lockwood

[11] 4,450,422

[45] May 22, 1984

[54] ELECTRONIC FILTER DEVICES

[75] Inventor: Larry R. Lockwood, McMinnville, Oreg.

[73] Assignee: Tektronix, Inc., Beaverton, Oreg.

[21] Appl. No.: 425,732

[22] Filed: Sep. 28, 1982

[51] Int. Cl.³ ..... H01P 1/218; H01P 1/213

[52] U.S. Cl. ..... 333/202; 333/219; 333/235

[58] Field of Search ..... 333/24.2, 167, 174–176, 333/101–103, 202–212, 219–236, 245, 246, 248; 324/307–316, 77 E, 78 F, 81; 331/49, 96–102

[56] References Cited

U.S. PATENT DOCUMENTS 3,010,085 11/1961 Seidel ..... 333/24.2

4,342,008 7/1982 Jewett ..... 331/49

*Primary Examiner*—Marvin L. Nussbaum

*Attorney, Agent, or Firm*—John Smith-Hill

[57] ABSTRACT

An electronic filter device comprises a high frequency section and a low frequency section. The high frequency section has an input coupling loop connected to an input connection of the filter device, and a gyromagnetic resonance element. The low frequency section comprises at least one inductor and at least one capacitor connected to the input coupling loop of the high frequency section. The two sections of the filter device have separate output connections.

7 Claims, 1 Drawing Figure

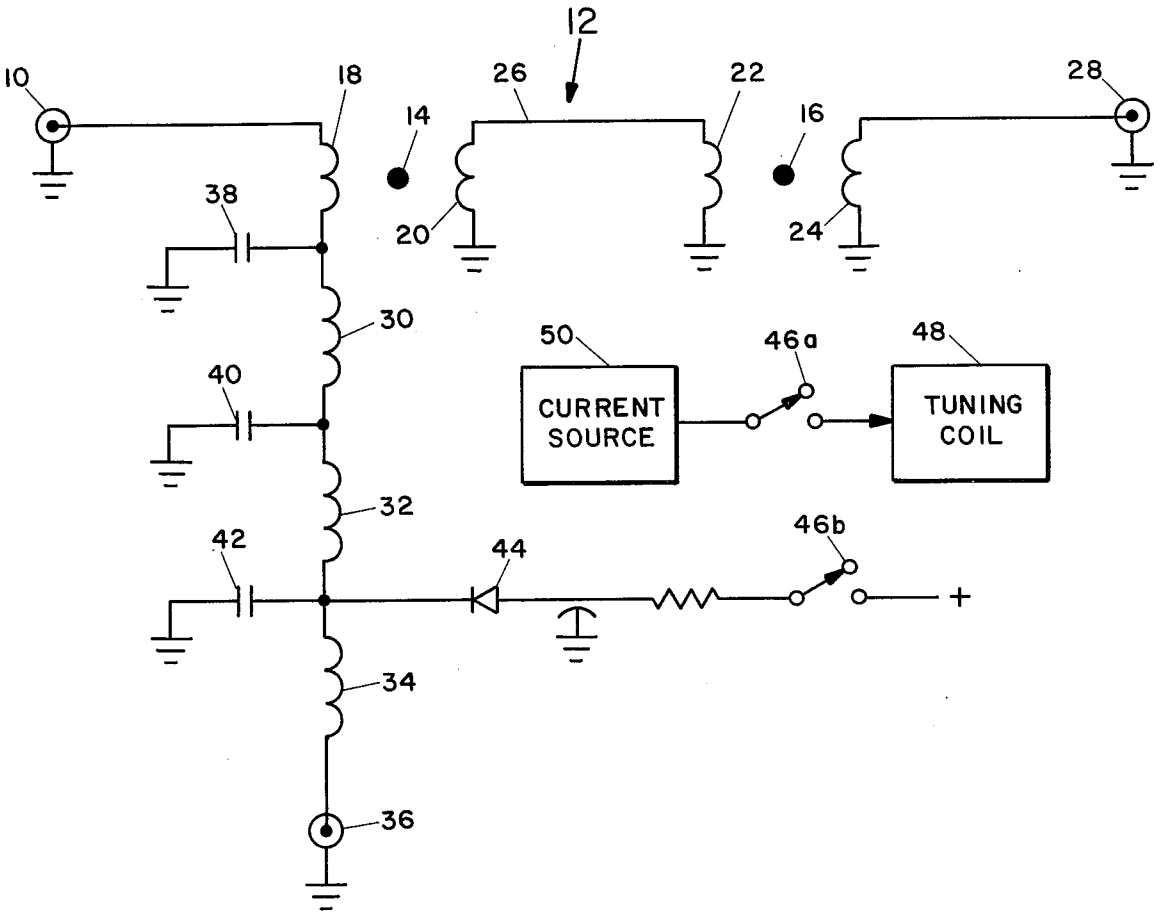
TUNING COIL
CURRENT SOURCE
+
10
12
14
16
18
20
22
24
26
28
30
32
34
36
38
40
42
44
46a
46b
48
50

ELECTRONIC FILTER DEVICES

This invention relates generally to electronic filter devices and, more particularly, to a filter device having a high frequency section and a low frequency section.

Broad band spectrum analyzers and sweep generators are designed to operate over a wide frequency range, which can extend from near d.c. (a few hertz) to many gigahertz. The extremely wide operating frequency range of these instruments makes it necessary to use several different types of filters for proper signal filtering. Typically, a band-pass YIG (yttrium iron garnet) filter is used for frequencies above 1.5 GHz, while a low-pass LC filter is used for frequencies below 1.5 GHz.

In a conventional spectrum analyzer or sweep generator, the appropriate filter may be selected manually by means of a switch which controls an electro-mechanical relay located in the input line to the filters. The relay functions to direct the input signal to the LC filter when the switch is in the low frequency position and to the YIG filter when the switch is in the high frequency position.

The electro-mechanical relays used for switching filter inputs in a spectrum analyzer or a sweep generator have proven to be somewhat unsatisfactory. It is difficult to obtain a relay which is capable of reliable operation over the full frequency range of the instrument. Additionally, the electro-mechanical relays are very expensive to obtain and replace.

The present invention may be used to provide an electronic filter device for operation over the frequency range from near d.c. to over 20 GHz. The filter device comprises the combination of a gyromagnetic resonance filter, preferably employing a garnet magnetic resonance element, such as yttrium-iron garnet, and an LC filter. Specifically, the input coupling loop of a YIG filter is integrated into the inductance of an LC filter. A low frequency input signal will pass through the LC filter, including the YIG input coupling loop, to provide a low-pass output. Similarly, a high frequency input signal will pass through the YIG filter, utilizing the same input coupling loop, to provide a band-pass output.

For a better understanding of the invention, and to show how the same may be carried into effect, reference will now be made, by way of example to the accompanying drawings, the single FIGURE of which is a schematic representation, partially in block form, of a combined YIG/LC filter embodying the present invention.

The filter illustrated in the drawing has an input signal port 10 which is connected to a YIG filter 12. The YIG filter 12 comprises first and second YIG spheres 14 and 16 and coupling loops 18, 20, 22, 24. The coupling loop 18 is connected at one end to the input signal port 10 and serves to couple the port 10 to the first YIG sphere 14. The coupling loops 20 and 22 are connected to each other by a conductor 26 and to ground, and serve to couple the YIG sphere 14 to the second YIG sphere 16. The coupling loop 24 is connected between ground and a bandpass output port 28 and serves to couple the YIG sphere 16 to the port 28. A tuning coil 48 is associated with the YIG spheres 14, 16, for establishing a magnetic field in the space in which the spheres are located. The tuning coil is driven by current supplied from a current source 50 under control of a switch 46A.

The opposite end of the coupling loop 18 from the port 10 is connected to one end of a series combination of three inductors 30, 32, 34, the opposite end of which is connected to a low pass output port 36. Three capacitors 38, 40, 42 each have one side connected to ground and the opposite side connected to that end of the inductor 30, 32, 34 which is nearer the coupling loop 18. The junction point of the inductors 32, 34 and the capacitor 42 is connected through a pin diode 44 to one contact of a switch 46B. The other contact of the switch 46B is connected to a positive voltage source. The switches 46A and 46B are provided by a double pole, single throw switch device.

In operation, an input signal is applied to the signal port 10. The input signal can range from near d.c. (a few hertz) to many gigahertz. In the event the input signal is in the low frequency operating range, below approximately 1.5 GHz, the switches 46A, 46B are placed in the open condition, as illustrated in the drawing. When the switches 46A, 46B are open, the tuning coil 48 is not driven and therefore the YIG filter is off resonance. In addition, the diode 44 is non-conductive. Under these conditions the coupling loop 18 is electrically an inductor (having an inductance on the order of one nanohenry) which, in combination with the capacitors 38, 40 and 42 and the inductors 30, 32 and 34, forms a low-pass LC filter, the output of which is provided at the port 36. It will be appreciated that the same effect could be obtained by maintaining the switch 46A open and tuning the YIG filter to a frequency which is away from the range of interest, defined by the pass band of the LC filter, for example 3 GHz.

In the high frequency mode of operation, i.e., above approximately 1.5 GHz, the switches 46A and 46B are closed. The switch 46A connects the current source 50 to the tuning coil 48 and the coil is driven to generate a magnetic field such that the resonant frequency of the YIG filter lies in a frequency range of interest. The YIG filter than operates as a band pass filter, transmitting signal components within the frequency range of interest to the port 28. In order to provide a flat amplitude response in the vicinity of the cut-off frequency of the low-pass filter, the switch 46B connects the pin diode 44 into the LC filter network at an electrical position which is equal to an integral number (including zero) of half wavelengths (at the cut-off frequency) along the transmission line formed by the LC filter from the coupling loop 18, whereby an apparent electrical short circuit to ground at the cut-off frequency is reflected at the end of the coupling loop 18 that is remote from the port 10.

It will thus be seen that the illustrated filter device permits switching between the band-pass section and the low-pass section without there being a relay or a mechanical switch connected in the input signal path.

It will be appreciated that the invention is not restricted to the particular filter which has been described and illustrated, since it will be apparent that variations may be made therein without departing from the scope of the invention as defined in the appended claims, and equivalents thereof. For example, gyromagnetic resonance elements made of a material other than yttrium-iron garnet may be used instead of the YIG spheres 14 and 16.

I claim:

1. An electronic filter device, comprising:

an input connection;

a high frequency section having an input coupling loop connected to said input connection, a gyromagnetic resonance element and a first output connection; and at least one inductor and at least one capacitor connected to said input coupling loop and forming a low frequency filter section therewith, said low frequency filter section having a second output connection.

2. An electronic filter device according to claim 1, wherein said high frequency filter section is a band-pass YIG filter including an output coupling loop which is connected to said first output connection, and at least one yttrium-iron-garnet resonator for transferring electromagnetic energy from the input coupling loop to the output coupling loop.

3. An electronic filter device according to claim 1, wherein said low frequency filter section is a low-pass LC filter.

4. An electronic filter device according to claim 1, comprising means for selectively providing an apparent ground to that end of the input coupling loop which is further from the input connection.

5. An electronic filter device according to claim 4, wherein said means for selectively providing an apparent ground comprise a pin diode which is switchable into said low frequency filter section.

6. An electronic filter device according to claim 5, wherein said low frequency filter section is a low-pass filter having a cut-off frequency, and said pin diode is coupled into said low frequency filter section at a position that is an integral number of half wavelengths at the cut-off frequency along the low frequency filter section from the input coupling loop.

7. An electronic filter device according to claim 5, wherein said high frequency filter section is a band-pass YIG filter including an output coupling loop, at least one yttrium-iron-garnet resonator, an electromagnet for applying a magnetic field to said resonator, and a source of energizing current for the electromagnetic, and said filter device includes switch means for disconnecting said source of energizing current from the electromagnet when the pin diode is switched out of the low frequency filter section.

* * * * *